US008033745B2

(12) United States Patent
Verlinden et al.

(10) Patent No.: US 8,033,745 B2
(45) Date of Patent: Oct. 11, 2011

(54) PRINTING SYSTEM WITH PRINTING TABLE RELEASABLY CLAMPED TO PRINTING UNIT

(75) Inventors: Bart Verlinden, Tongeren (BE); Bart Verhoest, Niel (BE); Werner Van De Wynckel, Wolvertem (BE); Albert Brals, Beek en Donk (NL); Markus Hilpert, Gundelfingen (DE)

(73) Assignee: Agfa Graphics NV, Mortsel (BE)

( * ) Notice: Subject to any disclaimer, the term of this patent is extended or adjusted under 35 U.S.C. 154(b) by 984 days.

(21) Appl. No.: 11/915,905

(22) PCT Filed: May 30, 2006

(86) PCT No.: PCT/EP2006/062707

§ 371 (c)(1),
(2), (4) Date: Nov. 29, 2007

(87) PCT Pub. No.: WO2006/128860

PCT Pub. Date: Dec. 7, 2006

(65) Prior Publication Data

US 2008/0199240 A1 Aug. 21, 2008

Related U.S. Application Data

(60) Provisional application No. 60/690,755, filed on Jun. 15, 2005.

(30) Foreign Application Priority Data

May 30, 2005 (EP) ..... 05104600

(51) Int. Cl.
*B41J 11/06* (2006.01)
*B41J 11/20* (2006.01)
*B41J 3/28* (2006.01)

(52) U.S. Cl. ..... 400/647; 400/630; 400/48; 101/114; 101/126; 347/104

(58) Field of Classification Search ..... 101/114, 101/126; 400/55, 56, 58, 645, 646, 647, 400/630, 48
See application file for complete search history.

(56) References Cited

U.S. PATENT DOCUMENTS 5,017,028 A * 5/1991 Harding ..... 400/48
5,265,533 A * 11/1993 Svantesson et al. ..... 101/123
5,547,292 A 8/1996 Harada
2004/0017456 A1 1/2004 Obertegger et al.

OTHER PUBLICATIONS

Official communication issued in the International Application No. PCT/EP2006/062707, mailed on Aug. 17, 2006.

* cited by examiner

*Primary Examiner* — Leslie J Evanisko
(74) *Attorney, Agent, or Firm* — Keating & Bennett, LLP

(57) ABSTRACT

A digital printer includes a digital printing unit for digital printing an image onto a printing substrate during relative movement between a print head and the printing substrate, and a printing table for holding the printing substrate during the digital printing. The printing table is firmly fixed to the digital printing unit during the digital printing of the image onto the printing substrate and is released from the digital printing unit prior to and after the digital printing of the image onto the printing substrate. The printing table may be moved between a printing position, in which it is firmly fixed to the digital printing unit, and a printing substrate feeding position, in which it supports feeding and removing of the printing substrate from the printing table.

9 Claims, 9 Drawing Sheets

PRINTING SYSTEM WITH PRINTING TABLE RELEASABLY CLAMPED TO PRINTING UNIT

CROSS-REFERENCE TO RELATED APPLICATIONS

This application is a 371 of PCT/EP2006/062707, filed May 30, 2006. This application claims the benefit of U.S. Provisional Application No. 60/690,755, filed Jun. 15, 2005, which is incorporated by reference. In addition, this application claims the benefit of European Application No. 05104600.1, filed May 30, 2005, which is also incorporated by reference.

BACKGROUND OF THE INVENTION

1. Field of the Invention

The present invention relates to a solution for integrating an industrial printing substrate transport system with digital printing units.

2. Description of the Related Art

More than a decade ago, multicolor inline screen printing systems began to make their appearance for printing multiple color large format graphics. They introduced improvements in print quality compared to a printing process using multiple single-color presses. The latter process suffered from substrate shrinkage and color registration problems between printing the different colors, particularly with thin paper and plastic substrates. Today, multicolor inline screen printing systems are highly automated and compete with offset printing for large format graphics. One of the benefits of multicolor presses is automated substrate handling. The majority of automated flatbed multicolor screen printing lines have an automated substrate handling system based on either gripper bars moving on a set of chains and pulling the printing sheet from one station to another (i.e., from one printing table to another) through the printing line, or moving platens wherein the entire platen or printing table, including the attached printing sheet, moves on a set of chains from one station to another through the printing line. The printing table is an important feature of the printing sheet transport system; it supports the printing sheet during transport through the printing line. In a screen print station, before the printing starts, the screen and the printing table holding the printing sheet are brought into a position facing each other at a distance called the off-contact distance. During printing, as the squeegee traverses along the print stroke, it pushes the screen against the printing sheet and presses the ink through the screen onto the printing sheet. The off-contact distance may range from "near contact" to as much as ⅜ inch or ½ inch, and depends on the size of the screen, the tension of the screen, the pressure of the squeegee on the screen, etc. Variations across the printing area of the off-contact distance are compensated by the pressure of the squeegee onto the screen so as to always ensure contact between the screen and the printing sheet during printing.

For digital non-impact printing technology, such as ink jet printing, it is known that the distance between the printing unit and the printing sheet is of major importance to enable correct operation of the printing technology. In ink jet technology, this distance is referred to as the throw-distance, and is typically in the range of 1 mm. Variations in throw-distance across the printing area are directly converted into variations in dot placement of printed pixels onto the printing sheet. Small variations in dot placement, especially if they are systematic, are known to be highly visible to the human eye.

Therefore, the position of the printing table relative to the printing unit should be accurately controlled and consequently is often regarded as an important feature of the digital print station.

In low-end ink jet printers, the throw-distance is often fixed by design/manufacture and the range of printing substrates that can be used with these printers is often limited to paper like substrates (from a substrate thickness point of view). In multi-use ink jet printers, a wide range of printing substrates (at least from a substrate thickness point of view) can be printed on. These printers often include a feature allowing the printing unit and/or the printing table to be vertically adjusted to control the throw-distance. Published patent application U.S. 2004/0017456 to Obertegger et al. discloses an ink jet printer having three possible ways to adjust the throw-distance, i.e., (1) a vertical adjustment of a print head relative to a print head carriage, (2) a vertical adjustment of a complete print head carriage system relative to the printer frame, and (3) a vertical adjustment of the printing table relative to a base element that refers to the printer frame. In practice, the throw-distance is set once as a function of the substrate thickness before the printing starts and this setting is maintained during printing. In theory, the throw-distance may be adjusted continuously during printing if a distance sensor would be installed on the print head carriage to continuously monitor the distance between the print head and the printing substrate surface, as disclosed also in U.S. 2004/0017456 to Obertegger et al. In practice however, continuously activating the various elements of the throw-distance adjustment system would lead to the introduction of undesired vibrations and mechanical instability of those parts, such as the print head carriage or the printing table, of which it is the goal to position them at a fixed distance relative to each other. The one-off calibration of the throw-distance at the start of a print job has proven to work satisfactorily if the mechanical and dynamic properties of the moving and stationary elements of the printer that influence the throw-distance are such that the one-off calibration can be maintained throughout the print job. For example, the weight of the carriage may introduce bending of the guides for transversal movement of the carriage across the printing substrate, high accelerations of the carriage may introduce deformations and vibrations in the carriage itself, the guides, and support frame for the transversal movement of the carriage across the printing substrate, etc.

If digital printing technology is to evolve towards industrial applications, it needs to meet the requirements of more printing substrate flexibility, higher print throughput, and integration with existing industrial printing equipment. One way to advance industrial applicability of digital printing technology is the integration of digital printing with industrial screen printing. However, throw-distance control would be a problem for at least two reasons. Firstly, the printing table in industrial screen printing presses is considered a feature of the printing substrate transport system and not of the printing unit itself, making it more difficult to control throw-distance. Secondly, the size of the printing table and of the printing unit may be so large that it is a problem to maintain absolute or relative position accuracy of the printing components across the whole of the printing area during the printing process. For digital printing technology, position accuracy in the range of micrometers is required.

The inventors of the present application have discovered that it would be advantageous to have a printing system wherein the printing table can be an integral part of the digital printing unit during printing, and wherein the printing table can be an integral part of the printing substrate transport system during transport of the printing substrates to and from the printing table. The inventors of the present application have discovered that a printing system having this capability would be able to control throw-distance during printing and guarantee compatibility with industrial printing substrate transport systems.

SUMMARY OF THE INVENTION

In order to overcome the problems described above, preferred embodiments of the present invention provide a digital printer having specific features and a method of printing as described below. With the digital printer according to preferred embodiments of the present invention, the distance between the digital printing unit and the printing table is fixed during the printing, and it provides the ability to create sufficient clearance between the digital printing unit and the printing table for feeding and removing the printing substrate from the printing table.

Other features, elements, processes, steps, characteristics and advantages of the present invention will become more apparent from the following detailed description of preferred embodiments of the present invention with reference to the attached drawing.

DETAILED DESCRIPTION OF PREFERRED EMBODIMENTS

Preferred embodiments of the present invention provide a solution to compatibility concerns of the printing sheet transport system of fully automated screen printing presses with digital printing units. One aspect of compatibility that is a concern is throw-distance, i.e., the distance between the print head(s) of the digital printing unit and the top surface of the printing sheet, during the printing.

Relevant Printer Parts

Figure 1:
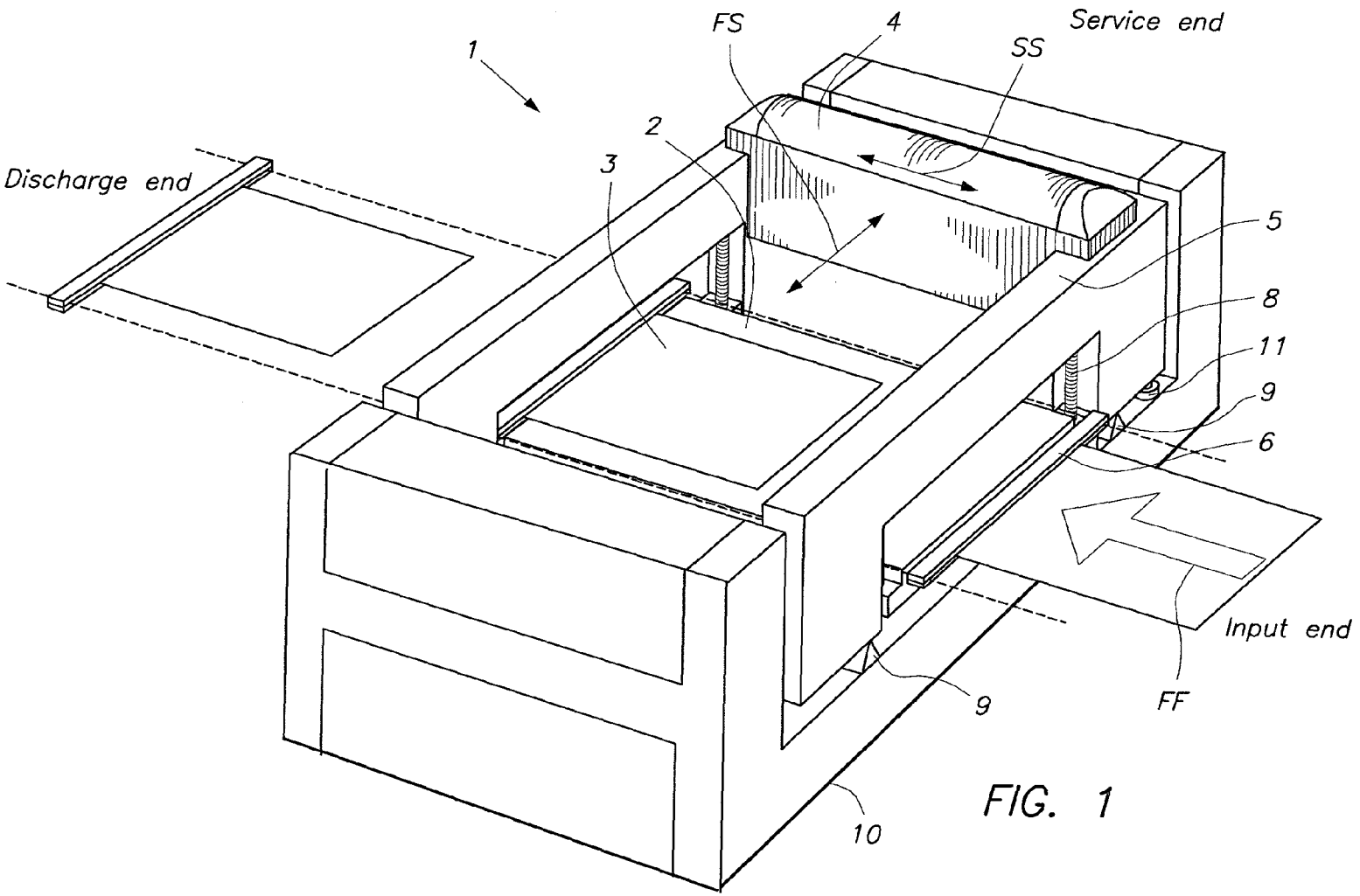
FIG. 1 shows a perspective view of a digital print station according to a preferred embodiment of the present invention.

A digital printer embodying a preferred embodiment of the present invention is shown in FIG. 1. The digital printer 1 includes a printing table 2 to support a printing sheet 3 during digital printing. The printing table is substantially flat and can support flexible sheets with thickness as low as tens of micrometers (e.g., paper, transparency foils, adhesive PVC sheets, etc.), as well as rigid sheets with a thickness up to some number of centimeters (e.g., hard board, PVC, cartons, etc.). A print head shuttle 4, including one or more print heads, is designed for reciprocating back and forth across the printing table in a fast scan direction FS and for repositioning across the printing table in a slow scan direction SS substantially perpendicular to the fast scan direction FS. Printing is performed during the reciprocating operation of the print head shuttle in the fast scan direction. Repositioning of the print head shuttle is performed in between reciprocating operations of the print head shuttle. A support frame 5 guides and supports the print head shuttle during its reciprocating operation. The support frame is further referred to as the metro(logical) frame 5 because of its importance as a mechanical reference in the printing process, as will become clear later on in the description. The metro frame sits on the printer base frame 10 via a number of vibration-absorbing suspension blocks 9, e.g., one suspension block in each corner of the metro frame. A printing sheet transport system can feed a printing sheet into the digital printer along a sheet feeding direction FF that is substantially perpendicular to the fast scan direction of the print head shuttle. The printing sheet transport system is designed as a "tunnel" or "guide through" through the digital printer, i.e., it can feed a sheet from one side of the printer (right side view in FIG. 1), position the sheet on the printing table for printing, and remove the sheet from the printer at the opposite side (left side view in FIG. 1).

In general terms, the digital printer may be considered as including three subsystems: (i) the assembly of the metro frame with the print head shuttle and print head(s), further referred to as the printing unit, (ii) the printer base frame, and (iii) the printing sheet transport system.

Printing Sheet Transport and Printing Table Interactions

The printing sheet transport system may be based on gripper bars known in the art of automated multicolor screen printing lines. With reference to FIG. 1, the printing sheet transport starts at the input end of the digital printer where a gripper bar 6 grabs the printing sheet along a leading edge of the sheet. The gripper bar pulls the printing sheet through the printer to finally lay off the printed sheet at the discharge end of the digital printer. The gripper bar follows a substantially horizontal path from the input end to the discharge end of the digital printer. The printing sheet is dragged with its leading edge following the substantially horizontal path.

Printing Table Transport Position

During transport of the printing sheet through the digital printer, the printing table is at a lower position to create clearance for the gripper bar and the attached printing sheet to pass over the printing table. This printing table position is further referred to in the description as the transport position.

Printing Table Alignment Position

When, during transport of the printing sheet, the gripper bar is at printing table height, the printing sheet transport system halts. The printing sheet may then be aligned with the printing table that will support the printing sheet during printing. Therefore, the printing table is raised to an alignment position. The alignment position of the printing table allows correct positioning of the printing sheet on the printing table.

If gripper bars are used, the printing sheet may be held in a clamp system of the gripper bar. The alignment process then may be a vertical and horizontal alignment of the printing table to the clamp of the gripper bar. Alignment of gripper bars to a printing table is known from screen printing equipment, e.g., the Thieme 5000 multicolor screen printing press available from Thieme GmbH. Aligning the printing sheet with the printing table may be important in cases where the printing sheet already includes printed data with which the digitally printed data needs to be registered, or in cases where the printing sheet is to receive additional printed data in register with the digitally printed data after removing the printing sheet from the digital printer. The additional or already printed data may be a white pre-coat to enhance color gamut, a spot color image, a finishing varnish to emphasize a particular portion of the printed image, etc.

Printing Table Printing Position

The alignment position of the printing table may or may not coincide with a printing position. The alignment position is determined by the gripper bar transport; the printing position will be defined by the throw-distance between the print heads on the print head shuttle, reciprocating back and forth across the printing sheet, and the printing surface of the printing sheet. After aligning the printing sheet with the printing table, the table is vertically moved towards a printing position. Prior to this action, the gripper bar may release the printing sheet. The printing table with the printing sheet is then moved towards the printing position while the gripper bar remains in the alignment position. Alternatively, the printing table, with the printing sheet still attached to the gripper bar, and the gripper bar may be moved together towards the printing position. In the printing position, the gripper bar may preserve the clamped condition of the printing sheet or release the printing sheet and withdraw to its alignment position. The latter may be preferred if the clamp mechanism of the gripper bar extends a distance above the top surface of printing sheet that is larger than the throw-distance used during printing, in which case the clamp mechanism of the gripper bar possibly physically interferes with the reciprocating print head(s) or print head shuttle. If the gripper bar releases the printing sheet prior to printing, it will take hold of the printing sheet again after printing.

To properly support and maintain the aligned position of the printing sheet onto the printing table when the printing sheet is released from the gripper bar, the printing table may be a vacuum table that can pull down the printing sheet to the printing table surface prior to the clamp of the gripper bar releasing the printing sheet, and vice versa release the printing sheet from the printing table surface after the clamp of the gripper bar takes hold again of the printing sheet. A vacuum table may also be advantageous to maintain the printing sheet flat during printing and to preserve throw-distance, irrespective of the gripper bar situation.

Figure 3A:
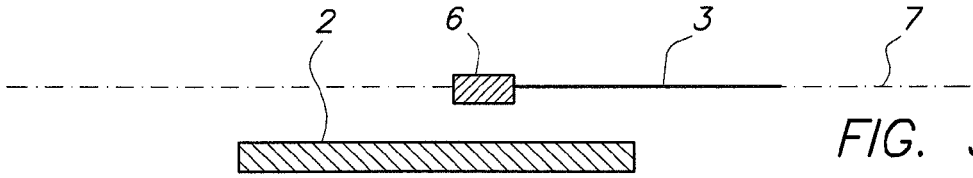
FIGS. 3A to 3I show an operating sequence of a printing sheet transport system that can be used with a digital print station according to a preferred embodiment of the present invention.
Figure 3B:
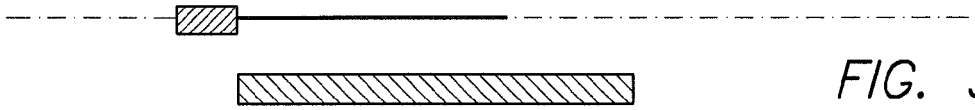
Figure 3C:
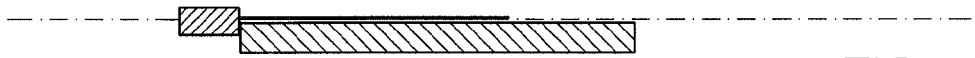
Figure 3D:
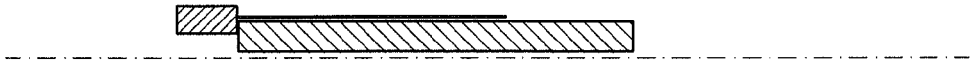
Figure 3E:
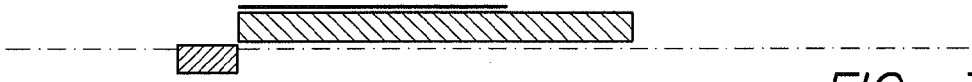
Figure 3F:
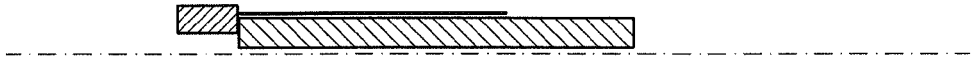
Figure 3G:
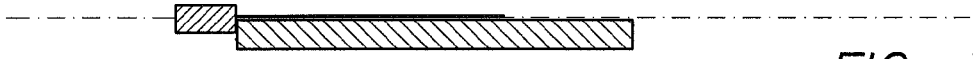
Figure 3H:
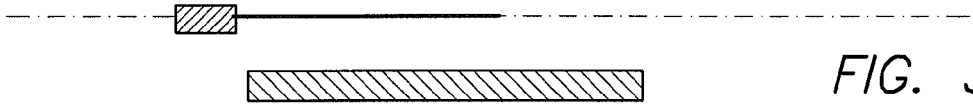
Figure 3I:
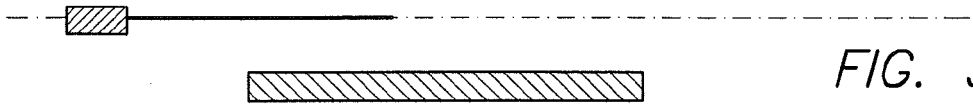

While the printing sheet is supported by the printing table, the print head shuttle reciprocates across the printing table and digitally prints onto the printing sheet. After digital printing, the process step sequence starting with halting the printing sheet transport while the printing table is in a transport position and ending with starting the digital printing when the printing table is in a printing position, is executed in reverse order and finally the printing sheet transport system resumes operation and removes the printing sheet from the printing table in the direction of the discharge end of the digital printer. The complete sequence of a preferred embodiment is illustrated in FIGS. 3A through 3I. In FIG. 3A, the printing table 2 is in a transport position and the gripper bar 6 is allowed to pass over the printing table. When the gripper bar is at the printing table height, as shown in FIG. 3B, the printing sheet transport system 7 halts and the printing table moves upward towards the alignment position as shown in FIG. 3C. In the alignment position, the printing sheet 3 attached to the gripper bar 6 is aligned with the printing table 2 and the printing table fully supports the printing sheet 3. The printing table together with the aligned gripper bar, may then be moved to a printing position shown in FIG. 3D. Prior to printing, the gripper bar preferably releases the printing sheet and withdraws to its normal position as in FIG. 3E. In the state of FIG. 3E, the printing sheet is digitally printed. After printing, the gripper bar again moves to align with the printing table in the printing position, and grabs the printed sheet as shown in FIG. 3F. The printing table together with the gripper bar returns to the alignment position in FIG. 3G. The printing table then moves further downwards to the transport position in FIG. 3H and allows the printing sheet transport system to remove the printed sheet from the printing table as shown in FIG. 3I. As already discussed, the movement of the gripper bar up and down between the printing table's alignment position and the printing table's printing position is optional and depends upon configuration options of the digital printer, e.g., whether or not the gripper bar releases the printing sheet during printing, at what stage the gripper bar releases the printing sheet, etc.

Figure 2:
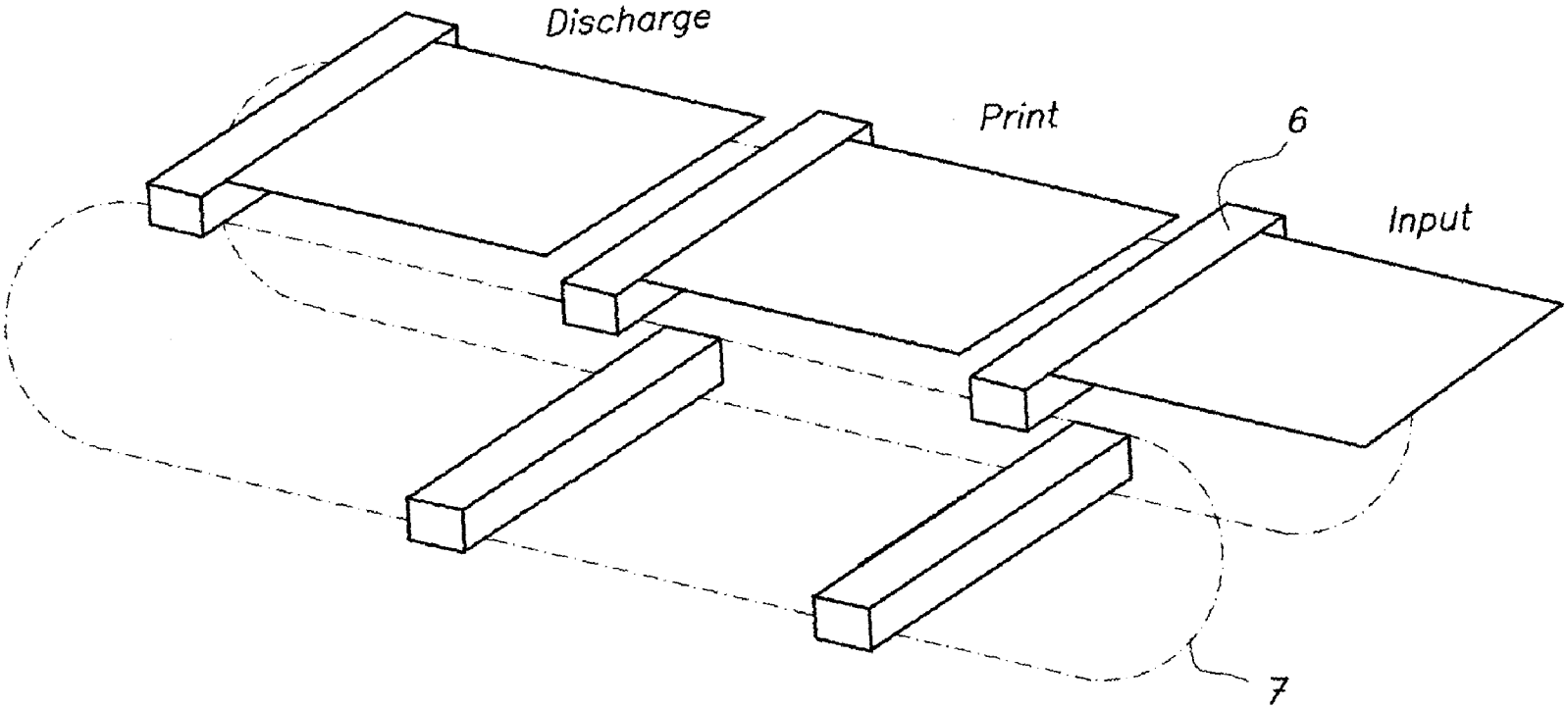
FIG. 2 shows a printing sheet transport system that can be used with a digital print station according to a preferred embodiment of the present invention.

The gripper bar executes a cyclic operation of (1) grabbing a printing sheet, (2) feeding the sheet to the printing table, (3) halting at the printing table and possibly releasing the printing sheet during printing, (4) removing the sheet from the printing table after printing, and (5) laying off the printing sheet. The gripper bar may then be transported back to the input end of the digital printer to grab the next printing sheet. Alternatively, multiple gripper bars may be used and positioned at a predefined distance from each other on an endless chain 7, as shown in FIG. 2. With an endless chain, a second gripper bar may arrive in a position for grabbing a second printing sheet at the input end of the printer once a first gripper bar has fed a first printing sheet to the printing table. A third gripper bar may arrive in a position for grabbing a third printing sheet at the input end of the printer once the second gripper bar has fed the second printing sheet to the printing table, and the first gripper bar has laid off the first printing sheet at the discharge end of the printer. Once a gripper bar has laid off a printing sheet at the discharge end of the printer, the gripper bar is transported back to the input end of the printer via the endless chain. These systems are known from automated multi-color screen printing lines. It may be preferable to include two endless chains to symmetrically drive or pull the gripper bars at their opposite ends and therefore avoid skew of the gripper bars and the attached printing sheets during printing sheet transport. The endless chain may be embodied as a physical chain or a belt or any other suitable endless transport. These endless transports may be driven with driving devices known in the art, e.g., a motor drive with a driven pulley and a set of supporting pulleys, or multiple synchronized motor drives and associated pulleys. The latter allows better tension control of the endless transport.

The transport position of the printing table may typically be centimeters below the alignment position or the substantially horizontal path of printing sheet's leading edge. The distance between the alignment position and the transport position should be large enough to create clearance for the gripper bar to pass, but not too large to allow the printing table in the transport position to support the dragging of flexible printing sheets by the gripper bar. A preferred distance between the transport position and the alignment position of the printing table may be in the range of about 11 cm to 1 cm, more preferably between about 8 cm and 4 cm, for example.

The printing position may be typically some centimeters above the alignment position and is determined by the throw-distance. In the preferred embodiment discussed so far, the height of the printing unit components relative to the printer base frame is fixed and therefore the printing position of the printing table depends on the thickness of the printing sheet. The printing position is preferably adjustable between 0 and about 10 cm, more preferably between about 0 and 2 cm, for example.

Other arrangements and printing table positions are possible and may depend on specific details of various preferred embodiments of the printing table alignment system, the gripper bar transport system, and the print head shuttle design.

In industrial printing applications, print throughput is an important and competing characteristic of any printing equipment. Time that is used for paper handling, i.e., feeding, aligning, and removing of printing sheets, is non-productive time and reduces print throughput. Reducing the paper handling time or paper handling duty cycle increases the speed of operations for all of the paper handling steps discussed with reference to FIGS. 3A to 3I.

In a preferred embodiment of the present invention, the paper handling time is reduced to about 5 seconds, and the printing time of a complete printing sheet is about 35 seconds. With printing table dimensions of about 2 meters by 3 meters and weighing about 700 kg, this inevitably results in high acceleration and deceleration forces that may be in the order of 1 $m/s^2$ to 2 $m/s^2$ and reaction forces that need to be taken care of without sacrificing stability of operation. These considerations have been taken into account in the printing table movement as discussed below.

Printing Table Movement

Any suitable device may be used to adjust the vertical position of the printing table, provided the devices are positioned outside the action radius of the printing process, e.g., the reciprocating print head shuttle and the printing sheet transport, e.g., the horizontal path of the gripper bars.

Figure 4:
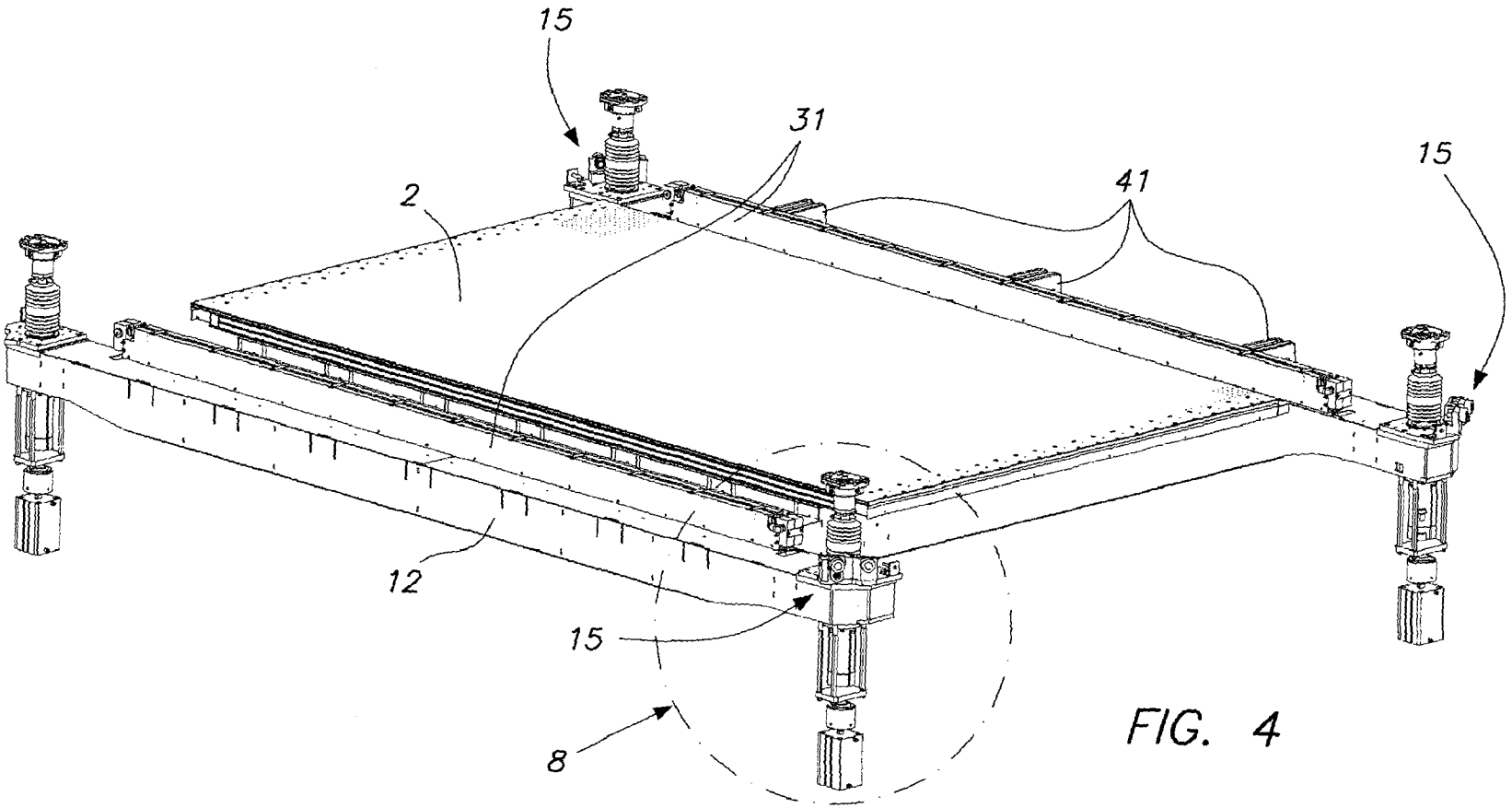
FIG. 4 shows a preferred embodiment of a printing table according to the present invention.
Figure 5B:
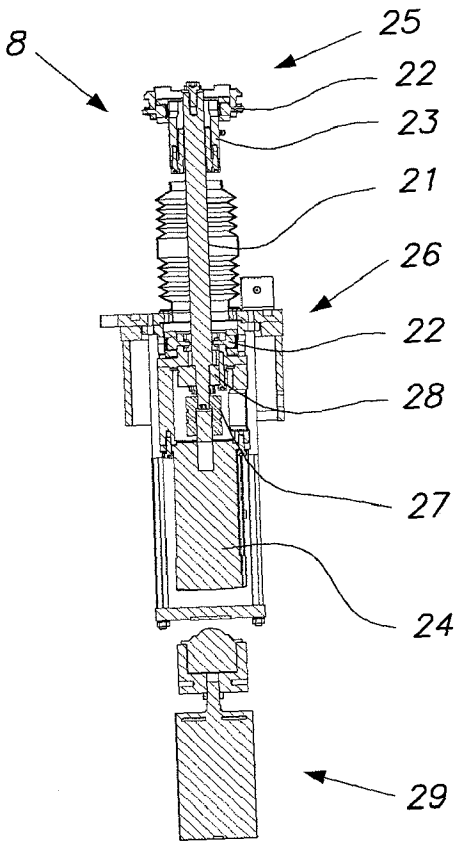
FIG. 5B shows a cross sectional view of the elements of the spindle drive system of FIG. 5A.
Figure 5A:
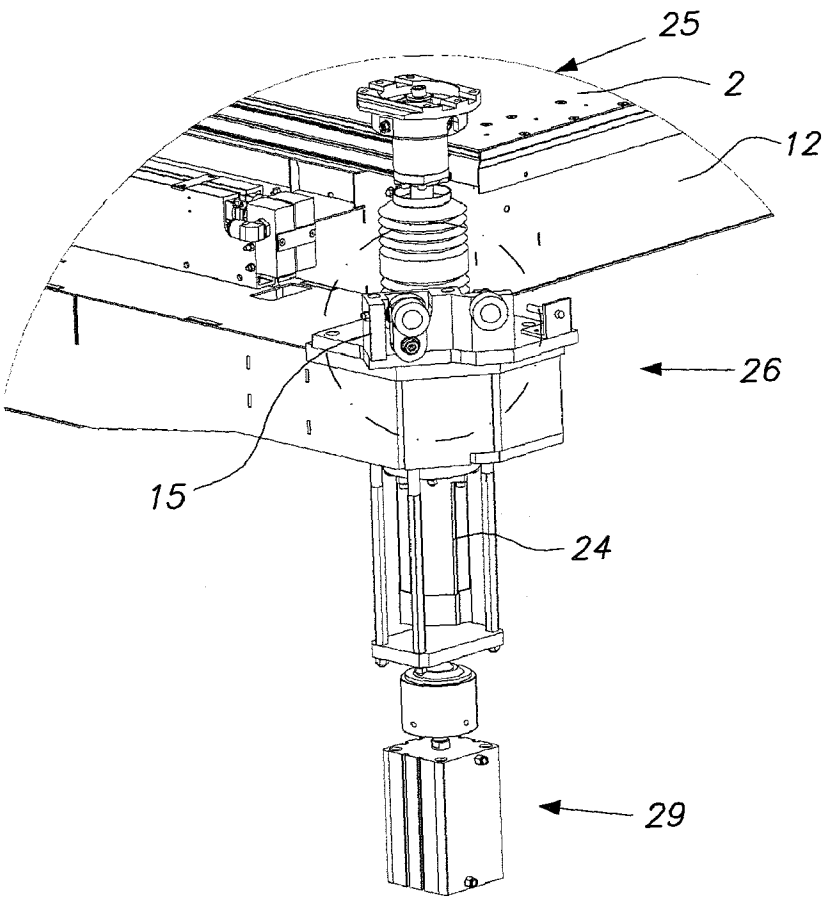
FIG. 5A shows a perspective view of a spindle drive system for linearly moving the printing table between a printing position and a transport position.
Figure 5C:
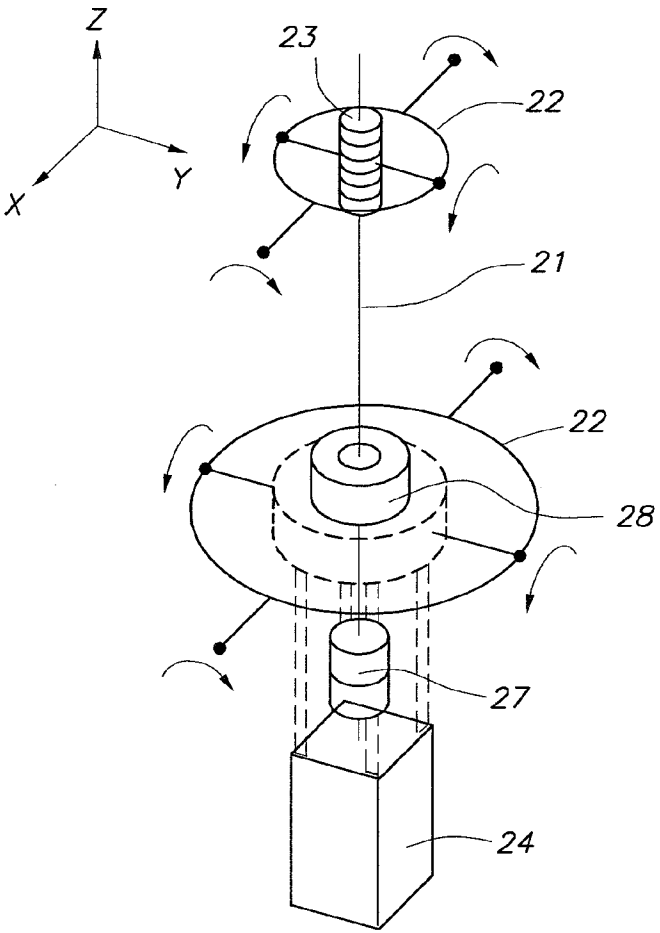
FIG. 5C shows the working principle of the cardan joints for mounting the spindle drive system.

In FIG. 4, the printing table 2 is supported by a printing table support 12 providing mounting locations for the vertical position adjustment devices outside the printing table area. The printing table support may be considered a mechanical extension of the printing table. The terms "printing table" and "printing table support" may be used alternately if it is clear from the context whether the printing table as such, supporting the printing sheet, or the printing table support, the mounting portion for the printing table, is used. The vertical position adjustment device shown in FIG. 4 includes vertically operating spindle drive systems 8 at each corner of a printing table support. Details of the spindle drive system are shown in FIG. 5A and FIG. 5B, FIG. 5B being a cross-sectional view of FIG. 5A. Each spindle drive system is preferably based on a rotation ball bearing spindle 21 that is mounted using universal or cardan joints 22 that allow the spindle axis to move away from its substantially vertical position into a slanted position without introducing mechanical stress. The working principle of this "two cardan joints" mounting concept is illustrated in FIG. 5C. The advantage of the cardan joints will become clear later on when thermal expansion of the printing table is discussed. The spindle rotates within a fixed nut 23 that is mounted via one of the cardan joints in a flange 25. This flange is mounted on the metro frame so that the spindle drive system is suspended from the metro frame. The spindle is fixedly mounted in a bearing unit 28 that itself is mounted in a corner block 26 of the printing table support 12 via the other cardan joint. By mounting the spindle drive system in each corner of the table support, with the corresponding flange mounted onto the metro frame, the complete printing table is suspended from the metro frame, as shown in FIG. 1. Rotation of the spindle screw in the fixed nut creates a vertical linear movement of the spindle along its axis. With the vertical movement of the spindle, the corner block also moves up and down along the spindle axis. The spindle is directly coupled using clutch 27 with a spindle motor 24 for rotating the spindle around its axis. The spindle motor may be a stepper motor, a servo motor, or any other type of motor suitable for accurately rotating the spindle. The spindle drive may also include a rotation absolute encoder for precise angular positioning of the spindle and linked therewith precise linear positioning of the table support corner block. The resolution of the rotation absolute encoder will determine the resolution of the linear movement of the table support corner block. The spindle drive system may be calibrated to link an absolute vertical position of the table support corner block, to an absolute angular position of the spindle. In a preferred embodiment, one rotation of the spindle may provide a vertical displacement of the table support corner block in a range of about 1 to 10 mm, for example. More preferably, one rotation of the spindle may provide a vertical movement in the range of about 4 to 6 mm, for example.

Operating the spindle drive systems in each of the four table support corners allows precise positioning of the printing table relative to the metro frame, i.e., the printing table may be leveled to the metro frame which is a feature that will allow accurate control of the throw-distance.

The vertical acceleration and deceleration of the printing table support, that is suspended from the metro frame via the spindle systems, imparts reaction forces into the metro frame that itself sits on the printer base frame via suspension blocks (see FIG. 1). In a preferred embodiment, with a printing table size of about 1700 mm by 2900 mm, the assembly of the printing table support and printing table itself may have a weight of about 700 kg, for example. Vertical accelerations and decelerations of about 1.5 $m/s^2$ imparts forces of about 1050 N into the metro frame, for example. To avoid resonance phenomena in the metro frame, the vertical movement of the printing table support is assisted by a set of pneumatic cylinders 29. A pneumatic cylinder is located right below each spindle drive system, as shown in the FIGS. 4, 5A, and 5B. The pneumatic cylinders are mounted on the printer base frame and push, when pneumatically driven, against the housing of the spindle drive system in a vertical direction. The pneumatic cylinder has a spherical surface contacting a horizontal surface of the housing of the spindle drive system. This type of contact allows horizontal displacement of the spindle drive system relative to the position of the pneumatic cylinder, e.g., to allow for thermal expansion of the printing table support, but also avoids a rigid mechanical connection between the printing table on the one hand and the printer base frame on the other hand. Because the pneumatic cylinder is pneumatically driven, the coupling in the vertical direction is not rigid. So the coupling between the spindle drive and the pneumatic cylinder has some compliance.

By use of a pressure controller using acceleration feed-forward signals from the spindle drive system, the pneumatic cylinders are driven to take over most of the acceleration and deceleration forces during printing table movement, as well as compensate for the gravity force during constant velocity or steady state of the printing table. By operation of the pneumatic cylinders, the bulk of the reaction forces will be imparted into the printer base frame instead of the metro frame.

The spindle drive systems 8, each being able to move a corner block 26 of the printing table support 12 up or down, are located substantially vertical. They are mounted to the metro frame by flanges 25. The bearing spindle 21 of a spindle drive system 8 is at one end mounted via a cardan joint in a corner block 26 of the table support 12, and rotates in a nut 23 that is mounted via another cardan joint in flange 25. Both cardan joints allow the bearing spindle and the spindle drive system to move away from its substantially vertical orientation into a slanted position. An advantage of these mounting features is that the printing table support and, mounted thereon, the printing table itself may thermally expand in a substantially horizontal plane without introducing stress forces and possibly mechanical deformation in the printing table or metro frame. As the table support expands substantially horizontally, the corner blocks move away from the table center. A radial shift of the corner block positions relative to the metro frame creates a slanted position of the spindle drive systems. The cardan joints support this slanted position without creating mechanical stress in the suspension of the table support to the metro frame. Also, thermal expansion of the metro frame relative to the printing table may be absorbed this way.

Figure 8B:
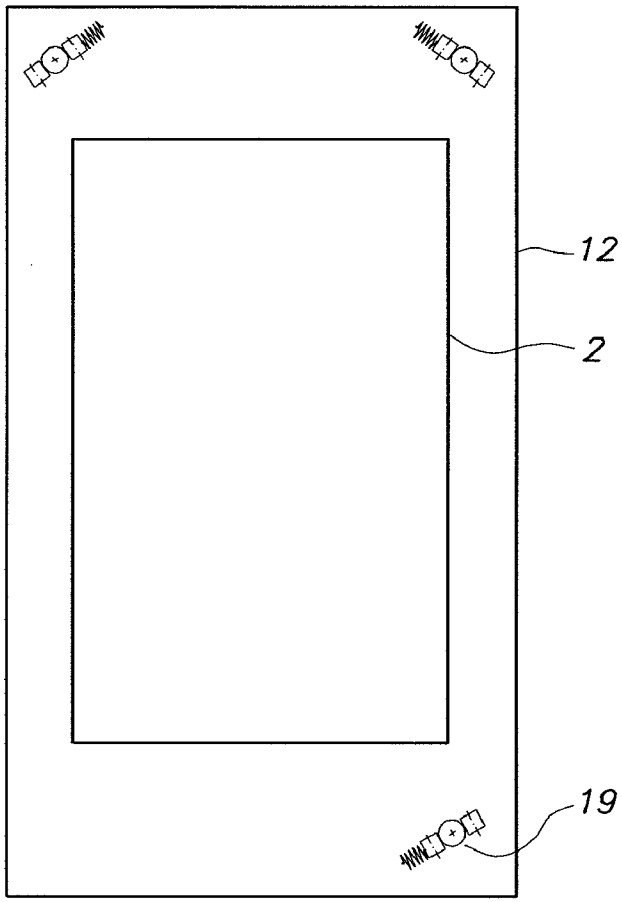
FIG. 8B shows the locations of the radial alignment systems on the printing table support.
Figure 8A:
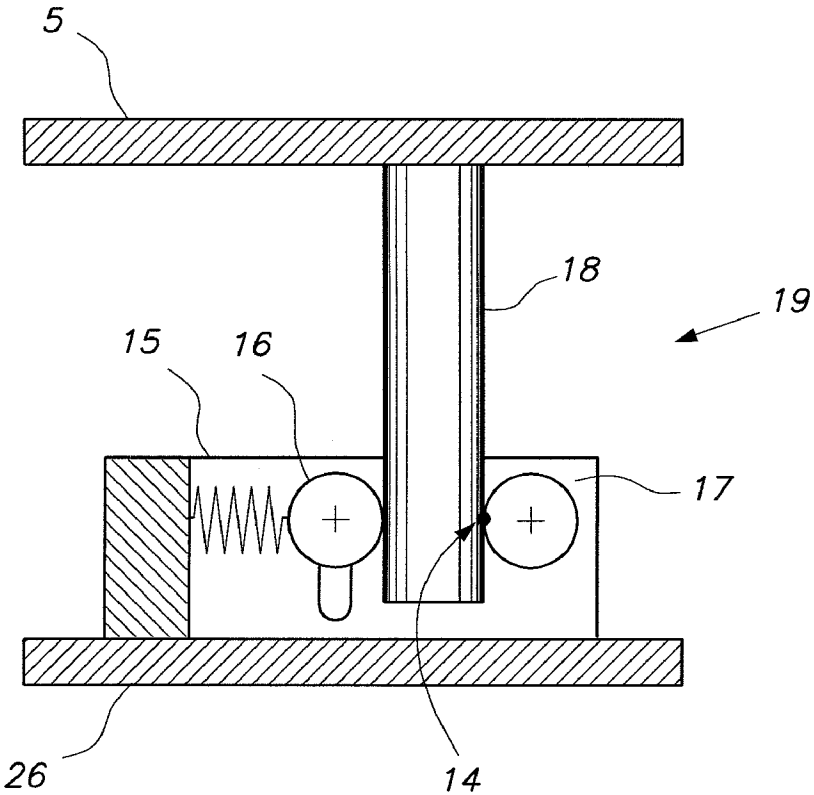
FIG. 8A shows a radial alignment system for positioning the printing table relative to the digital printing unit.

Three of the four corner blocks of the table support are equipped with a radial alignment system 19, shown in FIGS. 5A and 8A, to keep the printing table aligned in the x and y directions relative to the metro frame. The radial alignment system is shown in more detail in FIG. 8A and includes a vertical cylindrical shaft 18 mounted as a reference on the metro frame 5 and a set of cylindrical wheels 16, 17 for clamping around the vertical shaft. Cylindrical wheel 17 is fixedly mounted on a radial alignment block 15 whereas cylindrical wheel 16 is spring-loaded mounted on the same block. Radial alignment block 15 is mounted on the corner block 26 of the table support in a direction substantially perpendicular to a diagonal of the printing table. See FIG. 8B for locations of the radial alignment systems 19, and thus the mounting locations of the radial alignment blocks. In FIG. 8A, this diagonal is perpendicular to the plane of the figure. In a more general configuration, the diagonal is a radian from the corner block of the table support through the center of the printing table. The contact point 14 between cylindrical wheel 17 and cylindrical shaft 18 provides a fixed radial reference to the center of the printing table. The spring-loaded wheel 16 forces contact between the cylindrical wheel 17 and the cylindrical shaft 18. During thermal expansion of the printing table or table support, the radial alignment system on three of the four corner blocks of the table support allow these corner blocks to move in a direction along a diagonal through the center of the printing table. This system preserves the center location of the printing table relative to the metro frame during thermal expansion of the printing table relative to the metro frame or vice versa. Only three radial alignment systems are used because a fourth one would yield the alignment system being hyperstatic.

The cardan joints in the spindle drives for suspending the printing table from the metro frame as well as the spring loaded wheels in the radial alignment systems of the printing table not only serve to absorb thermal expansion of the printing table and metro frame relative to each other but also serve to catch mechanical position tolerances on alignment features. Instead of making the printer construction hyperstatic, the different assemblies in the printer construction are designed to accept mechanical tolerances.

Printing Unit Slant

In large industrial printing equipment, printing tables may have a size up to 2 meters by 3 meters and larger, and print head shuttles may span the full width of the printing table as shown in FIG. 1 and weigh up to 500 kg and more, for example. This often leads to large and heavy printing parts. One effect of these printer characteristics is bending of printing parts and guiding systems, e.g., bending of the metro frame guiding the print head shuttle as the shuttle moves across the printing sheet. A preferred solution to this problem will be discussed later in the description. Another effect of these printer characteristics is slanting of printing parts and guiding systems, e.g., slanting of the metro frame when the print head shuttle is at a home or service position beside the printing table, i.e., at one end of the metro frame. A slanted position of the metro frame is the result of unequal loads on the four suspension blocks by which the metro frame sits on the printer base frame. The slanted position of the metro frame is transferred to all printing parts mounted on the metro frame, including the printing table suspended from the metro frame with the spindle drive systems. This slanted position, for example, is present during printing sheet transport when the print head shuttle is in a home or service position. The slanted position of the metro frame and the printing table may create a mechanical interference problem with the substantially horizontal path of the printing sheet transport system, especially the moving gripper bars. A preferred solution to this problem is provided by adding two pneumatic cylinders 11 operating between the metro frame and the printer base frame at the home or service position of the print head shuttle. The pneumatic cylinders are mounted on the printer base frame and underneath the print head shuttle's home or service position, one at each side of the metro frame, and when pneumatically driven, push the metro frame upward to compensate for the gravity force of the print head shuttle when it is located in the home or service position. The pneumatic cylinders operate only in a printing sheet transport mode. They do not operate during printing, when the print head shuttle reciprocates back and forth, because slanting or swinging of the metro frame on its suspension blocks during printing is not a problem since the printing table will be an integral part of the 'swinging' digital printing unit, as will be explained later on in the section on printing table clamping. A 'swinging' digital printing unit during the printing does not create any mechanical interference problems.

Other drive systems may be thought of and used to create a similar functionality for the pneumatic cylinders.

Control and Preservation of Throw-Distance During the Digital Printing Unit (Table Clamping)

One of the major concerns for the digital printing equipment according to preferred embodiments of the present invention is the preservation of the throw-distance during the whole printing process. In general terms, the throw-distance may be defined as the distance between a digital print applicator, e.g., an ink jet print head mounted on a print head shuttle, and a printing surface, e.g., the top surface of a printing sheet. The throw-distance is set prior to the start of the printing process and while the print head shuttle is in a home position beside the printing table. The throw-distance is controlled by vertical movement of the printing table relative to the print applicator, i.e., the print head.

A major concern for preserving the throw-distance in large industrial printing equipment is the rigidity of the printing unit. In large format printing equipment, printing tables may have size up to 2 meters by 3 meters and larger, print head shuttles may span the full width of the printing table and weigh up to 500 kg and more, for example. This often leads to large and heavy printing parts. An effect of these preconditions is bending of printing parts and guiding systems, e.g., bending of the metro frame guiding the print head shuttle as the shuttle moves across the printing sheet. A problem resulting from this effect is the variation in throw-distance, i.e., the spacing across the printing area between the print head shuttle having the print heads on board and the printing table. A preferred solution to this problem is provided by firmly fixing the printing table to the metro frame during the printing process, which has the advantages of increasing the rigidity of the metro frame by adding the printing table to the printing unit assembly and of firmly fixing the throw-distance because the printing table will follow the same bending profile as the metro frame (if any bending is still present).

Clamping Along the Fast Scan Direction

Figure 6A:
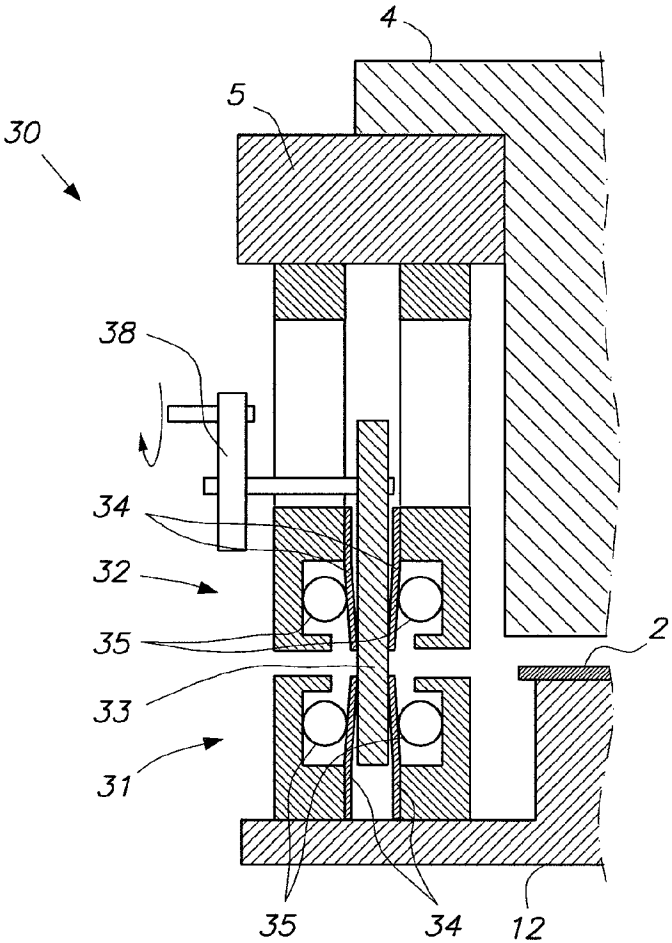
FIG. 6A shows a cross sectional view of a clamping system according to a preferred embodiment of the invention when it is in a closed condition.
Figure 6C:
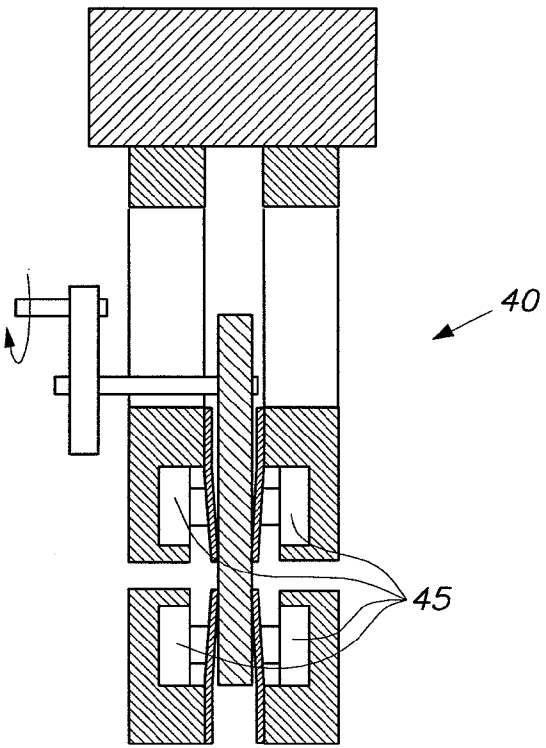
FIG. 6C shows an alternative preferred embodiment of a clamping system according to the present invention.
Figure 6B:
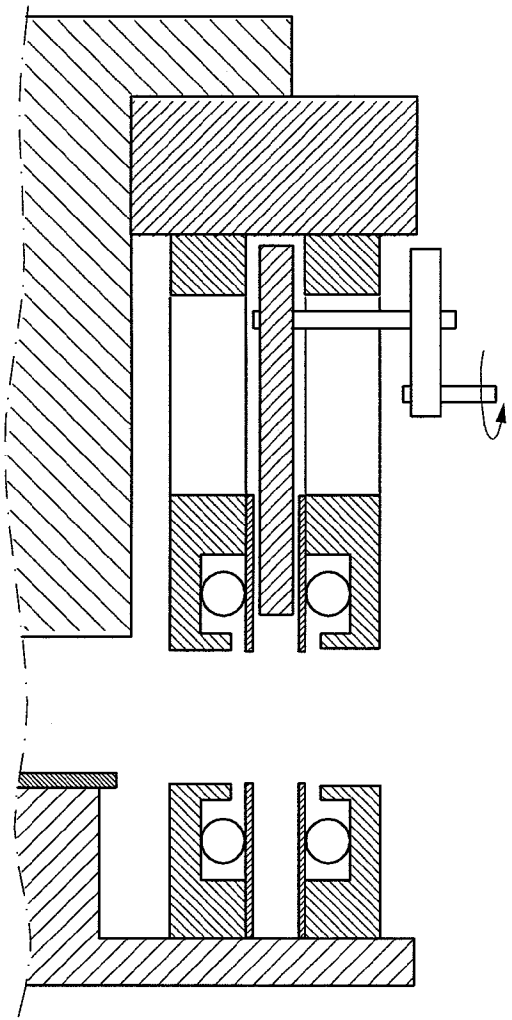
FIG. 6B shows a similar clamping system of FIG. 6A in an open condition.

The firm fixing of the printing table to the metro frame may be realized by a longitudinal clamping system 30 as shown in FIGS. 6A and 6B. FIGS. 6A and 6B show a cross sectional view perpendicular to the fast scan direction of the print head shuttle 4, metro frame 5, printing table 2, and printing table support 12. FIG. 6A shows a clamping system, at the left side of the printing table, in a clamped condition; FIG. 6B shows a similar clamping system, at the right side of the printing table, in a released condition. The longitudinal clamping system may extend along substantially the full length of the printing table as indicated in FIG. 4, showing the printing table part of the clamping system, and in the direction of the fast scan movement of the print head shuttle, i.e., the direction along which the bending of the metro frame occurs. The clamping system has a first fork portion 31 mounted on the printing table support and a second fork portion 32 mounted on the metro frame. A knife part 33 of the clamping system may simultaneously engage with the first fork and the second fork. A blade system including two pairs of blades 34, i.e., a first pair of blades belonging to the first fork portion mounted on the printing table and a second pair of blades belonging to the second fork portion mounted on the metro frame, may sandwich the knife in its engaged position and firmly link the first fork portion and the second fork portion of the clamping system together. Sandwiching the knife is done by pressing each of the blades against the knife, as shown in FIG. 6A. Therefore, the blades may be considered as leaf springs. The pressure forces are generated by inflating the tubes 35 that push their corresponding blade against the knife by expansion of the tube. The clamping system just described is preferably activated prior to starting the printing process and when the print head shuttle is in a home or service position beside the printing table, i.e., a position in which the bending of the metro frame by the weight of the print head shuttle is minimal. The clamped state of the printing table is maintained until after the digital printing on the printing sheet.

After the digital printing on the printing sheet, the reverse operation is executed, i.e., the printing table is released from the metro frame. This is done by deflating the tubes, thereby removing the pressure from the blades. The blades withdraw and will release the knife from the clamping system. If the printing table is released from the metro frame, the printing table can be moved towards its transport position as shown in FIG. 6B for creating a passageway for the printing sheet transport system to remove a printed sheet from the printing table and feed a new printing sheet to the printing table. The knife of the clamping system may optionally be completely withdrawn into the fork portion mounted on the metro frame, as shown in FIG. 6B, using a lever system 38. This creates additional clearance space for the printing sheet transport system.

It has been effective that common fire hoses may be used as inflatable tubes, although other types of hoses may be used as well. It has also been effective that, when short response times are required for clamping and releasing of the printing table, active deflating of the tubes is preferred above passively releasing the pressed air from the inflated the tubes.

The clamping system along the fast scan direction may be implemented as a single substantially full length clamp, as indicated in FIG. 4, or be implemented as a set of smaller clamps positioned along the fast scan direction.

Clamping Along the Slow Scan Direction

It will be understood that a clamping system along the fast scan direction is important because the bending of the metro frame occurs along the fast scan. A clamped printing table provides additional rigidity to the digital printing unit and provides a fixed throw-distance between the print head(s) and the printing surface of the printing sheet. The clamping system further prevents rocking of the printing table relative to the metro frame, in the fast scan direction, which may occur as a result of acceleration and deceleration forces from the print head shuttle. The clamping system in the fast scan direction is not designed to provide stiffness in the slow scan direction. Therefore, the system does not prevent rocking of the printing table in the slow scan direction. Resistance to rocking of the printing table in the slow scan direction, as well as in the fast scan direction, is to some extent provided by the radial alignment systems 19 located in three of the four corners of the printing table. It may therefore be preferable to provide a number of additional clamps acting to secure the position of the printing table in the slow scan direction. These will further increase the rigidity of the digital printing unit as a whole and increase robustness against rocking of the printing table in the slow scan direction. The transversal clamp systems 40 acting in the slow scan direction may be positioned as indicated in FIG. 4, wherein the fork portions 41 of transversal clamping systems 40, mounted on the printing table support, are distributed along one side of the table and next to the fork portions 31 of transversal clamping systems 30 in the fast scan direction. Other locations of the transversal clamp systems as well as number of transversal clamp systems are of course possible, and may depend on printer parameters such as the size of the table, bending profile of the metro frame, weight of the shuttle, etc. In a particular preferred embodiment, the transversal clamps acting in the slow scan direction may use a different actuation mechanism because they are shorter than the longitudinal clamps acting in the fast scan direction. Instead of inflatable tubes, clamping modules 45 like those commercially available by Festo may be used. Especially for short clamp systems, these clamp modules are better suited than inflatable tubes. The EV type clamping modules from Festo are fast and are especially suited for clamping slightly uneven parts, which is the case with the bending blades. In the EV type clamping modules from Festo a pressure plate is mounted on a diaphragm that is part of a pressure chamber. The diaphragm is displaced by application of compressed air. So the small clamps along the slow scan direction operate with the same energy source as the large clamps along the fast scan direction, which is an engineering advantage. A preferred embodiment using these clamp modules 45 is shown in FIG. 6C.

The clamps acting in the slow scan direction are preferably operated simultaneously with the clamps acting in the fast scan direction, but they may be operated separately as well.

Mechanical or operational aspects of the transversal clamp systems, not discussed thus far, are assumed to be similar to those of the longitudinal clamp systems.

Compatibility of Clamping Systems with Printing Substrate Transport Systems

In the discussions above, the focus was on the compatibility of the printing table clamping mechanism with the printing sheet transport system of multicolor screen printing lines.

The clamping mechanism may, however, also be used in combination with a printing web transport system. As shown in FIG. 4, the clamping mechanism along the fast scan direction, as well as the clamps perpendicular thereto, are positioned outside the fast scan path of the print head shuttle 4. The clamping mechanism configurations not only provide a free path for the print head shuttle 4, they also provide a free path for a printing substrate transport system. Therefore, a printing substrate transport system supporting a printing web may also be used, provided that the printing web runs substantially parallel with the main (longitudinal) clamping mechanism 30. In general terms, if the printing substrate transport direction is substantially parallel with the clamping mechanism of the printing table, then printing webs and printing sheets may be used. If, however, the printing substrate transport direction is not substantially parallel with the clamping mechanism of the printing table, e.g., substantially perpendicular to, as shown in FIG. 1, then only sheeted printing material may be used.

The concept of fixing the printing table to the digital printing unit during the printing and releasing the printing table from the printing unit for feeding and removing of the printing substrate from the printing table is also compatible with manual feeding setups. The releasing of the printing table from the digital printing unit provides clearing for the operator the position of a printing sheet on the printing table and removal of the printing sheet from the printing table. For example, if the digital printer would be added in a work flow where standalone manual screen printing stations are already used, e.g., to add variable data to already screen printed sheets or to replace a number of single color screen printing stations with one full color digital printing station, then the concept of fixing the printing table to the digital printing unit improves the quality and registration of the printed data within the digitally printed image and between the digitally printed image and a previously or subsequently screen printed image.

Printing Process

Printing may start when a printing sheet is supported on the printing table, the printing table is in the printing position, and clamped to the metro frame to create a unitary solid printing unit with a secured throw-distance. As shown in FIG. 1, the print head shuttle reciprocates across the printing table in a fast scan direction, while printing on the sheet. The printing sheet remains in a fixed position during printing. The number of fast scans that is required to print a full image onto the printing sheet may depend on details of various preferred embodiments of the print head shuttle, e.g., number, width, and setup of the print heads; and/or on the print quality targets, e.g., resolution or shingling/interlacing strategy used. A printed image may be obtained in one fast scan operation if the print head shuttle includes a full width print head or print head assembly. If the print head shuttle includes a print head or print head assembly with a print width smaller than the width of the sheet or the image to be printed, multiple fast scans will be required. In between two fast scans, the print head shuttle is shifted in a slow scan direction substantially perpendicular to the fast scan direction to reposition the print head or print head assembly above a non-printed or only partially printed area of the sheet. Printing methods involving shingling or interlacing strategies improve image quality at the expense of additional fast scan operations of the print head shuttle with intermediate repositioning of the print heads along the slow scan direction.

Alternative Preferred Embodiments

In the discussion on printing table positions, it has been explained that one of the vertical movements of the printing table is controlled relative to the position of the substantially horizontal path of the gripper bars of the printing sheet transport system, and is physically measured relative to the position of the metro frame because the printing table is suspended with the metro frame via the printing table support.

As an alternative to moving the printing table between different relative positions, the printing table may be held in a fixed position and the gripper bars of the printing sheet transport system may be moved into a raised position relative to the printing table while passing over the printing table during transport of the printing sheet, and lowered to their normal position to align with the printing table for printing on the printing sheet. The raised position of the gripper bars does not conflict with the narrow throw-distance specification because the gripper bars pass over the printing table while the print head shuttle is in a home or service position beside the printing table, as explained before.

Alternative preferred embodiments for the clamping system may include a preferred embodiment wherein, instead of using two inflatable hoses to press the pair of blades against the knife, one of the inflatable hoses is replaced by a fixed bar. In this setup, the clamping force is generated by only one inflatable tube pushing the blade-knife-blade setup against the opposing fixed bar.

In the preferred embodiments shown in the drawings, the hoses or clamping blocks and blade assemblies are mounted in a fork that are made from machined solid material. An advantage of machined solid metal is its intrinsic rigidity and its ability to rigidly mount these fork portions to frames. The high cost of machined solid parts is however a disadvantage. Alternatively, the forks may be manufactured from sheet metal, which is cheaper to manufacture but provides less rigidity to the structures. In order to maintain the strength of the clamping system, especially shear between the knife and the pair of blades of the sheet metal forks, it may be preferable to extend these blades and mount them together with the sheet metal forks to the metro frame or the printing table.

Preferred embodiments other than spindle drives based on spindle rotation may be used for adjusting the vertical position of the printing table. These may include electric or pneumatic driven piston devices suspended with the metro frame and pushing the printing table support against the acting gravity force from underneath the corner blocks. Alternatively, lift mechanisms located underneath the printing table, mechanically referring to the printer base frame and controlled with distance feedback signals from the metro frame to printing table distance, may be used.

In the digital printer shown in FIG. 1, the fast scan direction of the print head is substantially perpendicular to the printing sheet transport direction. The fast scan direction may also be chosen to be in the same direction as the printing sheet transport direction. A choice of fast scan direction may be inspired by throughput considerations. The fast scan direction may depend on the dimensions of the printing table, i.e., it may be preferable to have the fast scan direction along the same orientation as the longest dimension of the printing table to optimize print throughput.

The digital printer as described is not limited to the use of a specific type of digital printing technique. Any type of digital print technology that can print on a printing sheet that is positioned on a substantially flat printing table can be applied. The applicable digital printing technologies may include impact printing technologies like transfer printing or non-impact printing technologies like ink jet printing. One of the differences between digital impact printing and digital non-impact printing is the distance between the digital print applicator and the printing surface of the printing sheet. In digital impact printing technology like transfer printing or xerographic printing, the digital print applicator is in "kiss" contact with the printing surface of the printing sheet, i.e., the throw-distance is controlled at zero μm, whereas in digital non-impact printing technology the throw-distance is controlled at a value larger than zero μm. In both cases however, control of the throw-distance within narrow ranges is important because most of the digital print applicators or application processes are highly sensitive to variations in applicator to printing surface distance.

A digital printer as described may be limited to monochrome printing if a single page-wide or non-page-wide print head or print head assembly is used. However, the print head shuttle may include multiple print heads or assemblies capable of printing different colors during a single fast scan operation. One of the advantages of a digital printer as disclosed is that it can offer full process color imaging in a single print station. This is considered one of the advantages of digital printing, i.e., a single print station may have full color printing capability. The digital print station may use a 4-color print head set (Cyan Magenta Yellow blacK), a hexachrome set (Cyan Magenta Yellow Orange Green blacK) or any other combination of color sets that allows covering a given color space.

Figure 7:
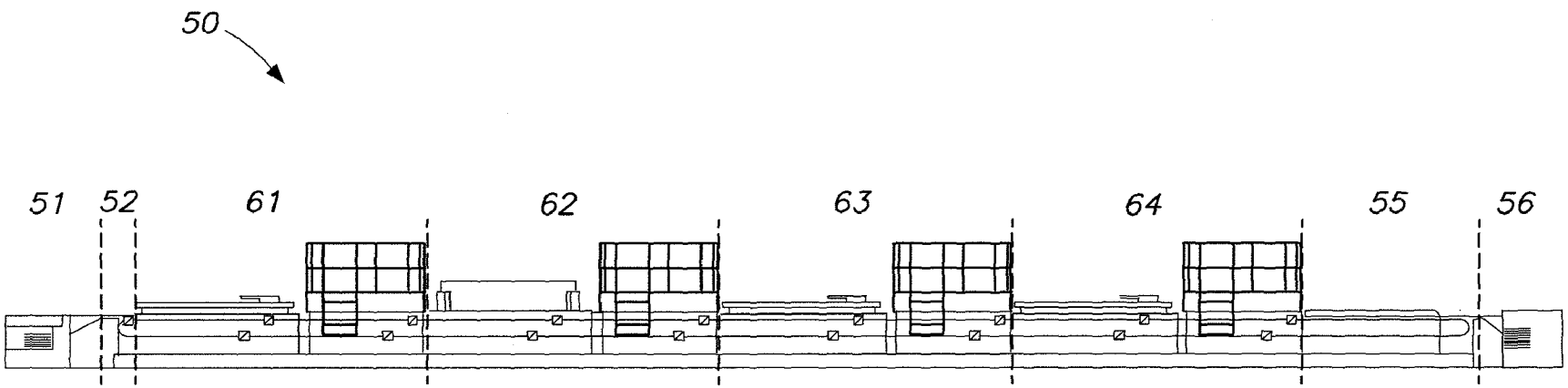
FIG. 7 shows a hybrid printing press using a digital print station according to a preferred embodiment of the present invention.

The digital printer as shown in FIG. 1 has been explained in great detail. The digital printer has been made compatible with industrial printing sheet transport systems used in the automated screen printing presses. The digital printer as described above may now be seamlessly integrated in an automated screen printing line and replace a number of conventional screen printing color stations because of the full process color capability of the digital print station. An example of such a hybrid printing press 50 is shown in FIG. 7. In FIG. 7, unit 62 is a digital print station as described above and stations 61, 63, and 64 are screen print stations or printing sheet pre-treatment or post-treatment stations. Units 51, 52, 55, and 56 are part of the printing sheet transport system that runs as a tunnel through the entire hybrid printing press from the feeder 51 to the stacker 56.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A printing press comprising:

a digital print station including a digital printing unit arranged to digitally print an image onto a printing sheet during movement of a print head across the printing sheet in a first direction;

a printing sheet transport system arranged to intermittently feed and remove the printing sheet from the digital print station;

a printing table arranged to support the printing sheet during feeding of the printing sheet to the digital print station and removing of the printing sheet from the digital print station, and providing an area arranged to hold the printing sheet during the digital printing; and a device arranged to firmly fix the printing table to the digital printing unit during digital printing and release the printing table from the digital printing unit during feeding of the printing sheet to the digital print station and removing of the printing sheet from the digital print station; wherein the device arranged to firmly fix the printing table to the digital printing unit is positioned outside the area arranged to hold the printing sheet; and the device arranged to firmly fix the printing table to the digital printing unit includes a first fork mounted on the printing table outside the area arranged to hold the printing sheet and a second fork mounted on the digital printing unit, a mechanism arranged to engage a knife with the first fork and with the second fork, and a fixing device arranged inside of each of the first and second forks to firmly fix an engaged position of the knife.

2. The printing press according to claim 1, wherein the device arranged to firmly fix the printing table to the digital printing unit includes at least one longitudinal clamp extending along the first direction.

3. The printing press according to claim 2, wherein the device arranged to firmly fix the printing table to the digital printing unit includes two longitudinal clamps extending in the first direction along substantially the full length of the printing table and positioned at opposite sides of the printing table.

4. The printing press according to claim 1, wherein the device arranged to firmly fix the printing table to the digital printing unit includes at least one transversal clamp extending along a second direction, the second direction being substantially perpendicular to the first direction.

5. The printing press according to claim 1, further comprising a mechanism arranged to move the printing table between a printing position, wherein the printing table is firmly fixed to the digital printing unit, and a transport position, wherein the printing table is part of the printing sheet transport system.

6. The printing press according to claim 1, wherein the printing table is suspended from the digital printing unit.

7. The printing press according to claim 1, further comprising a screen print station arranged to screen print onto the printing sheet seamlessly integrated into the printing press such that the printing sheet transport system intermittently feed and removes the printing sheet to and from each of the digital and screen print stations.

8. A method of digital printing on a printing sheet comprising the steps of:

feeding the printing sheet to a printing table using a printing sheet transport system, the printing table having a printing table area arranged to hold the printing sheet during the digital printing;

firmly fixing the printing table to a digital printing unit;

digital printing onto the printing sheet by moving a print head shuttle including a print head across the printing sheet while the printing table is firmly fixed to the digital printing unit;

releasing the printing table from the digital printing unit;

removing the printing sheet from the printing table area using the printing sheet transport system, wherein the printing table is firmly fixed to the digital printing unit outside the area arranged to hold the printing sheet;

moving the printing table to a print position prior to firmly fixing the printing table to the digital printing unit; and moving the printing table to a transport position prior to the feeding of the printing sheet to the printing table or the removing of the printing sheet from the printing table.

9. The method according to claim 8, further comprising the step of:

positioning the print head shuttle in a home position beside the printing table prior to firmly fixing the printing table to the digital printing unit.

* * * * *